United States Patent [19]

Kuroishi et al.

[11] Patent Number: 4,614,638

[45] Date of Patent: Sep. 30, 1986

[54] PROCESS FOR PRODUCING SINTERED FERROUS ALLOYS

[75] Inventors: Nobuhito Kuroishi; Mitsuo Osada; Akio Hara, all of Hyogo, Japan

[73] Assignee: Sumitomo Electric Industries, Ltd., Japan

[21] Appl. No.: 805,413

[22] Filed: Dec. 6, 1985

Related U.S. Application Data

[63] Continuation of Ser. No. 604,435, May 1, 1984, abandoned, which is a continuation of Ser. No. 255,392, Apr. 20, 1981, abandoned.

[30] Foreign Application Priority Data

Apr. 21, 1980 [JP] Japan ..... 55-53439
Apr. 22, 1980 [JP] Japan ..... 55-53813

[51] Int. Cl.[4] ..... B22F 1/00

[52] U.S. Cl. ..... 419/39; 419/19; 419/54; 419/58; 419/59; 419/57

[58] Field of Search ..... 75/233, 244, 246; 419/14–16, 19, 25, 29, 39, 54, 57–59

[56] References Cited

U.S. PATENT DOCUMENTS 1,040,699 10/1912 Ladoff ..... 419/57
2,826,805 3/1958 Probst et al. ..... 419/39
2,933,386 4/1960 Pessel ..... 75/224
3,109,735 11/1963 Googin ..... 419/57
3,168,607 2/1965 Greene ..... 148/131
4,028,100 6/1977 Latva ..... 75/224

OTHER PUBLICATIONS

McGannon, Harold E. (ed.), The Making, Shaping and Treating of Steel, 1964, pp. 1080–1130.

*Primary Examiner*—John F. Terapane
*Assistant Examiner*—Anne Brookes
*Attorney, Agent, or Firm*—Sughrue, Mion, Zinn, Macpeak, and Seas

[57] ABSTRACT

A method for producing a sintered ferrous alloy containing at least one alloying element whose standard free energy for oxide formation at 1,000° C. is 11,000 cal/g mol $O_2$ or less is described. The method comprises a sintering procedure comprising steps of elevating the temperature of a green compact comprising said at least one alloying element, sintering it in a sintering furnace and cooling it, wherein the pressure in the sintering furnace is maintained at between about 0.2 and 500 Torr by supplying a reducing gas during at least a part of the sintering procedure under reduced pressure.

19 Claims, 3 Drawing Figures

PROCESS FOR PRODUCING SINTERED FERROUS ALLOYS

BACKGROUND OF THE INVENTION

This invention relates to a process for producing sintered ferrous alloy products in powder metallurgy having high mechanical strength, toughness, heat resistance, wear resistance, and electromagnetic properties, as well as high dimensional accuracy and stability.

Production of precision parts by powder metallurgy has recently seen great advances because of its high economy resulting from the absence of the need of cutting and other machining operations and its potential for mass production. The process basically consists of placing a mixture of metal powders or alloy powders in a mold, pressing the mixture into a desired shape, and sintering the shaped mixture at elevated temperatures to provide a product having desired strength, wear resistance characteristics and electromagnetic properties. For a given material and forming density, the strength, toughness, electromagnetic and other properties of the sintered product depends upon whether successful sintering is achieved. If successful sintering is not effected, the desired characteristics mentioned above are not obtained. In addition, high dimensional accuracy is not achieved consistantly, subsequent pressing and other machining operations such as sizing are necessary for correcting the dimensions of the sintered product, and hence, the economy of powder metallurgy is reduced. In this sense, the sintering technique is a very important factor in powder metallurgy, and in particular, the control of temperature and atmosphere for sintering are most important since they directly affect the quality of the product produced by powder metallurgy.

One of the purposes of sintering is to bond metal particles thermally at a temperature lower than the melting point of the metal, and another is to diffuse the particles of a dissimilar metal. The two requirements that must be satisfied by any atmosphere for sintering are: (1) it removes the gas adsorbed on the surface of the metal particles and reduces the oxide on said surface; and (2) it prevents oxidation, carburization, and decarburization during sintering. Among the sintering atmospheres currently used in powder metallurgy are an endothermic modified gas, hydrogen gas, decomposed ammonia gas (cracked $NH_3$) nitrogen gas, vacuum, and each has its own merits and demerits.

(I) Endothermic modified gas

The endothermic modified gas is prepared by modifying a propane- or butane-containing hydrocarbon gas with air, and today it is the most commonly used atmosphere for producing Fe—Cu—C or Fe—Ni—C base sintered parts. But it contains only 11% CO and 17% $H_2$, by weight, respectively, and its reducing capability is low. With this gas, the sintering of a material containing Cr, Mn, Si, V or other easily oxidizable elements is virtually impossible, because oxides such as $Cr_2O_3$, MnO, and $SiO_2$ are very hard to reduce.

(II) Decomposed ammonia gas

The decomposed ammonia gas generally consists of 75% $H_2$ and 25% $N_2$. Its reducing capability is much higher than that of the endothermic modified gas. If the dew point is kept at between about −50° and −60° C., even $Cr_2O_3$ can be reduced with the decomposed ammonia gas, but the reduction of MnO or $SiO_2$ is practically impossible. Furthermore, this gas provides a decarburizing atmosphere, so one problem with it is difficulty in the control of carbon content when it is used in sintering a carbon-containing material.

(III) Hydrogen

Hydrogen has high reducing capability resulting from the reaction represented by $MO+H_2 \rightarrow M+H_2O$ (wherein M is a metal). The progress of this reaction depends on the ratio of the partial pressure of $H_2O$ to that of $H_2$, $P_{H2O}/P_{H2}$. To carry out the reduction of a metal oxide satisfactorily, the partial pressure of $H_2O$ must be reduced, and to reduce the partial pressure of $H_2O$, both the purity and amount of hydrogen supplied to the sintering furnace must be increased. This is not an economical practice because a great quantity of the expensive gas is lost. Like the decomposed ammonia gas, hydrogen causes decarburization at high temperatures due to the resulting $H_2O$ or the $H_2O$ contained in the gas supplied ($H_2O+C \rightarrow CO+H_2$), so precise control of the carbon content is difficult.

(IV) Nitrogen

Nitrogen has been used either independently or in admixture with a reducing gas such as hydrogen, decomposed ammonia gas or hydrocarbon. This practice is economical since no modifying apparatus is required, but on the other hand, its reducing capability is low and the sintering of a material containing an easily oxidizable element such as Mn, Cr, Si or V is very difficult.

(V) Vacuum

Sintering in vacuum is characterized in that the gas adsorbed on the product can be removed easily and, also, it is free from reaction with the gas constituting the sintering atmosphere. However, a solid reducing agent such as graphite is necessary for initiating reduction; on the other hand, if such solid reducing agent is used, precise control of the carbon level is as difficult as in the case of the gases (I) to (IV).

As described above, several atmospheres are currently used for commercial sintering operations, but those having high reducing capability cause decarburization and make control of the carbon level difficult, whereas those atmospheres in which the carbon level can be controlled have low reducing capability and are not able to sinter a material containing an easily oxidizable element such as Mn, Cr, Si, or V. Furthermore, even if steel containing these elements having high affinity for oxygen is successfully sintered, they may be oxidized again in a subsequent heat treatment and the resulting product does not have the desired strength, toughness, or wear resistance.

SUMMARY OF THE INVENTION

Therefore, one object of this invention is to provide a novel economical process for producing sintered ferrous alloys having high mechanical strength, toughness, heat resistance, wear resistance, and electromagnetic properties.

Another object of this invention is to provide a novel method of sintering and heat treatment that is free from the defects of the conventional techniques for sintering and heat treatment, and which can be adapted for the production of a sintered steel containing Mn, Cr, V, Si, Ti, Al and other elements having high affinity for oxygen.

Still another object of this invention is to provide a novel sintering method that eliminates the defects of the conventional method and which is capable of producing a high-permeability magnetic alloy containing Si, Al or B, or sintered stainless steel containing Cr or Mn and having high resistance to corrosion and heat, none of which can be produced by the conventional sintering method.

According to this invention a method for producing a sintered ferrous alloy containing at least one alloying element whose standard free energy for oxide formation at 1,000° C. is 11,000 cal/g mol $O_2$ or less is provided which comprises a sintering procedure comprising steps of elevating the temperature of a green compact comprising said at least one alloying element, sintering it in a sintering furnace and cooling it, wherein the pressure in the sintering furnace is maintained at between about 0.2 and 500 Torr by supplying a reducing gas during at least a part of the sintering procedure under reduced pressure.

According to one feature of this invention, a reducing gas (carbon monoxide or hydrogen) is supplied to the sintering furnace during at least a part of the sintering procedure comprising the steps of temperature elevation, sintering and cooling. The amount of reducing gas supplied depends on the progress of reaction. By supplying the reducing gas in such a manner, the partial pressure of gas in the furnace is controlled so that the oxidation of the above named elements during the sintering process is prevented and part of the oxide is reduced to accelerate the alloying of the component, while at the same time, carbon detrimental to magnetic properties and corrosion resistance is eliminated.

The concept of the method of this invention as applied to the production of the sintered steel is as follows:

(1) Sintering

With the pressure in the sintering system maintained at subatmospheric pressure, carbon monoxide gas is supplied to the furnace at a rate that depends on the progress of the sintering while the ratio of the partial pressure of carbon dioxide to that of carbon monoxide in the furnace is controlled to accelerate the sintering and the reduction of oxides; and (2) Heat treatment In the cooling step subsequent to the sintering step (1), quenching is performed, or, in a later stage of sintering, nitrogen gas, decomposed ammonia gas, or a trace amount of hydrocarbon gas is supplied to achieve sintering without contact with the external air, and to perform quick and precise nitridation or carburization of the surface of the product in an activated state.

DETAILED DESCRIPTION OF THE INVENTION

Figure 1:
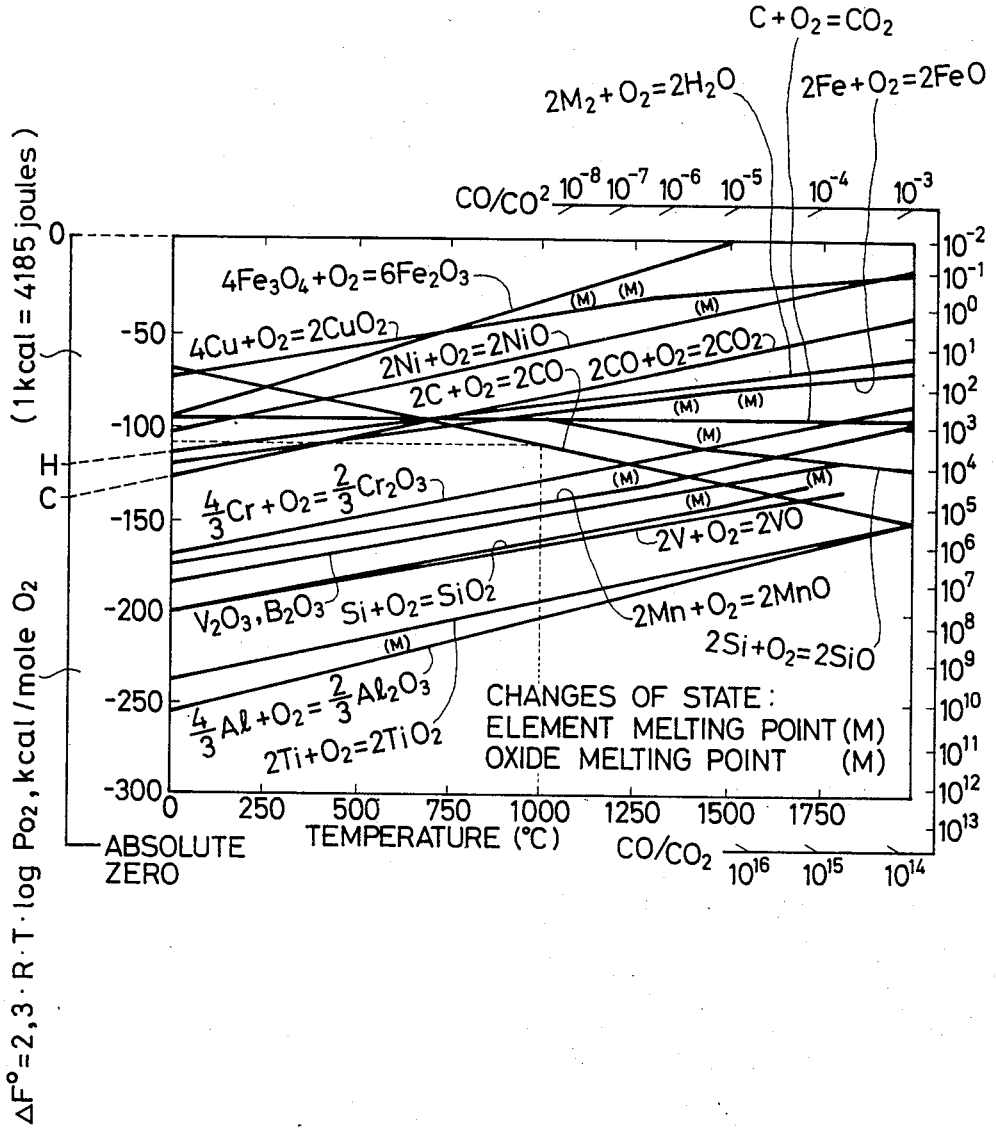
FIG. 1 is a diagram showing the relation between temperature and the standard free energy of an element for oxide formation.

The method of this invention is applicable to production of sintered ferrous alloys containing one or more alloying elements having high affinity for oxygen such as Mn, Cr, Si, Al, B or Ti whose standard free energy for oxide formation versus temperature calculated from thermodynamic data is depicted in FIG. 1.

With respect to sintering procedure the term "earlier stage" used herein means a stage between the point in time when sintering temperature is reached and the middle point of a period during which sintering temperature is kept, and the term "later stage" indicate a stage between the middle point and the end of the period.

The rationale of the supply of a reducing gas and the control of partial gas pressure according to the invention is described below. In the sintering of a green compact or compacted alloy powder for production of a sintered ferrous alloy product, the following four reductive reactions can occur:

$$MO + C \rightarrow M + CO \quad (1)$$

$$MO + CO \rightarrow M + CO_2 \quad (2)$$

$$CO_2 + C \rightarrow 2CO \quad (3)$$

$$MO + H_2 \rightarrow M + H_2O \quad (4)$$

In the foregoing, M represents a metal atom.

The change in the free energy for these reactions is represented by the following equation: $\Delta G = \Delta G^\circ + RT \ln K$. The constant K assumes the values $P_{CO}/A_C$, $P_{CO_2}/P_{CO}$ and $P_{22O}/P_{H_2}$ for the respective reactions wherein $P_{CO}$, $P_{CO_2}$, $P_{H_2O}$ and $P_{H_2}$ indicate the partial pressures of CO, $CO_2$, $H_2O$ and $H_2$, respectively and $A_C$ represents activity of carbon, so it is assumed that the progress of the reactions (1) to (4) depends on the partial gas pressure in the respective reaction systems. Therefore, the control of the partial gas pressure of the respective oxides is assumed to be important for accelerated reduction thereof and enhanced sintering (see FIG. 3).

Taking the reduction of $Cr_2O_3$ in a Cr-containing system as an example, the following reaction can occur:

$$3Cr_2O_3 + 17CO \rightarrow 2Cr_3C_2 + 13CO_2 \quad (I)$$

$$7Cr_2O_3 + 33CO \rightarrow 2Cr_7C_3 + 27CO_2 \quad (II)$$

$$23Cr_2O_3 + 93CO \rightarrow 2Cr_{23}C_6 + 81CO_2 \quad (III)$$

$$Cr_2O_3 + 3CO \rightarrow 2Cr + 3CO_2 \quad (IV)$$

$$C + O_2 \rightarrow 2CO \quad (V)$$

Figure 2:
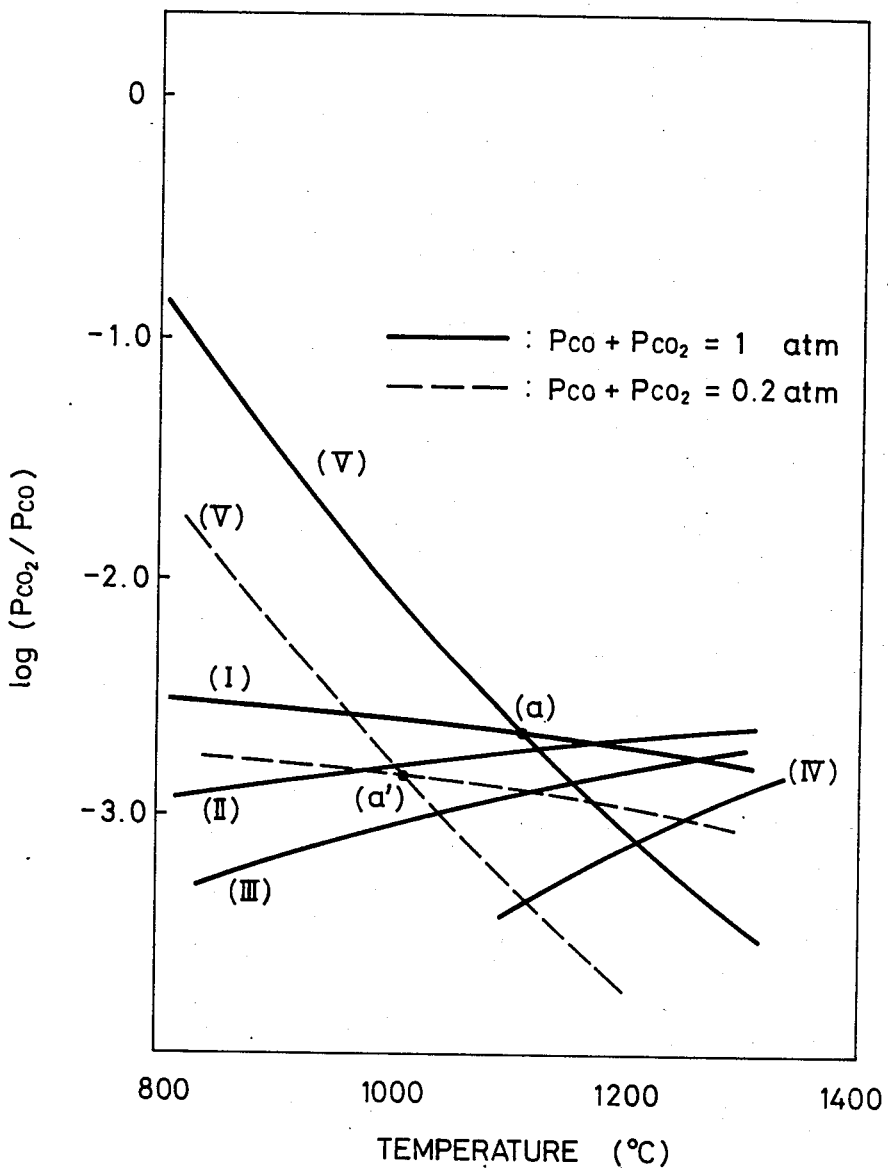
FIG. 2 is a diagram showing the relation between temperature and the $P_{CO_2}$ (i.e., the partial pressure of $CO_2$) to $P_{CO}$ (i.e., the partial pressure of CO) ratio for providing equilibrium in each of the reactions (I) through (V) described hereinafter.

FIG. 2 shows the relation between temperature and the $P_{CO_2}$ to $P_{CO}$ ratio for providing equilibrium in each of these reactions that is determined on the basis of the thermodynamic data compiled by Jubaschewski et al. In FIG. 2, the temperature at which the reduction of $Cr_2O_3$ starts when the total pressure ($P_{CO} + P_{CO_2}$) is 1 atm. is 1120° C., which is represented by the crossing point (a) of the equilibrium partial pressure lines for the reactions (V) and (I). When the total pressure is reduced to 0.2 atm. (ca. 146 Torr), the respective equilibrium partial pressure lines shift downward as indicated by the broken lines, and as a result, the temperature at which the reduction of $Cr_3O_3$ starts is 1020° C. at the point (a') which is about 100° C. lower than when the total pressure is 1 atm. This means the reduction of $Cr_2O_3$ is accelerated.

The above mechanism also applied to the reduction of other oxides, such as MnO and $Fe_2O_3$. Accelerated reduction is one of the two advantages of the sintering performed under reduced pressure (in vacuum). The other advantage which has already been monitored is the ease with which gas adsorbed on the surface of metal particles can be removed. Based on this, it would appear that the higher the degree of vacuum, the easier the reduction of the oxide and sintering. But this does not happen in actual cases. According to experiments, the reduction of oxides such as $Cr_2O_3$ and MnO is difficult even if the degree of vacuum is increased beyond a certain level that would appear to be useful.

As a result of various studies on why this is so, it has been found that the problem is the removal of the gases produced in the course of reduction. Indeed, sintering in vacuum is very effective for accelerated reaction in the earlier stage because of the ease of removal of the adsorbed gas and the decreased temperature at which the reduction starts, but in the middle to later stage, the gases produced are not removed satisfactorily and the progress of reduction and sintering decreases sharply. One possible reason for this phenomenon is that a gas has a long means free path in vacuum, making it difficult to remove the resulting gases through pores in the compressed powder. Consequently, the $P_{CO_2}$ to $P_{CO}$ ratio in the pores is increased to retard the progress if reduction and sintering. This invention solves the problem by controlling the partial gas pressure in the sintering furnace with a reducing gas that is supplied in an amount that depends on the progress of the sintering process comprising the steps of temperature elevation, sintering, and cooling. According to one preferred embodiment of this invention, a furnace having a dimension or 600 mm×600 mm×1000 mm is used for sintering green compacts of 5 to 100 mm in diameter in a stage having a temperature higher than 800° C. subsequent to evacuation to vacuum in the earlier stage of sintering, carbon monoxide gas is supplied in an amount of 0.2 to 20 liters/min. while it is continuously evacuated to control the pressure at between about 0.2 to 500 Torr so that the reductions of (1) to (3) and (I) to (V) may be performed most efficiently. The probable reasons to explain this is that diffusion between the carbon monoxide gas supplied and the resulting gas enables smooth removal of the latter so as to decrease the $P_{CO_2}/P_{CO}$ ratio that has increased in some parts of the powder during sintering. The most efficient reduction requires the precise control of the timing of the supply of carbon monoxide, temperature, pressure, gas flow rate, and the atmosphere and pressure conditions for the stages before and after the supply of carbon monoxide. Specific requirements are set forth below.

(1) Sintering

| Temperature | Atmosphere & pressure | |
|---|---|---|
| | A | |
| room temp. → 800–900° C. | vacuum | $10^{-1}$ Torr or less |
| 800–900° C. → sintering temp. | CO | 0.2–100 Torr |
| sintering temp. | CO | 0.2–100 Torr |
| sintering temp. → room temp. | $N_2$ | 0.3–1500 Torr |
| | B | |
| room temp. → 800–900° C. | vacuum | $10^{-1}$ Torr or less |
| 800–900° C. → sintering temp. | CO | 100–500 Torr |
| sintering temp. | vacuum | $10^{-2}$ Torr or less |
| sintering temp. → room temp. | $N_2$ | 0.3–1500 Torr |

In the method of this invention, the sintering furnace is evacuated to a pressure of $10^{-1}$ Torr or less in the stage where it is heated from room temperature to a temperature between 800° and 900° C. prior to the supply of carbon monoxide gas, and as already explained, this is for the purpose of removing the gas adsorbed on the surface of metal particles and for accelerating the reduction of the oxide. In a conventional method of sintering for producing cemented carbide, nitrogen gas having a temperature between 800° and 1200° C. is supplied before the supply of carbon monoxide gas, but one object of this invention is to reduce even oxides of Mn, Cr, V, Si and other elements that have much higher affinity for oxygen than W and Co. To achieve this end, the above specified requirements for atmosphere and pressure in the stage that precedes the supply of carbon monoxide must be met. When the treatment is effected in a hydrogen atmosphere, $H_2O$ produced in the reaction represented by $MO+H_2 \rightarrow M+H_2O$ (wherein M is a metal) promotes rather than inhibits the oxidation of Mn, Cr, V, Si and other elements having high affinity for oxygen, and, consequently, the overall efficiency of reduction is decreased significantly. According to experiments, the conventional process takes about ten times as long to reduce an Fe—Mn—Cr—C system as does our process.

Figure 3:
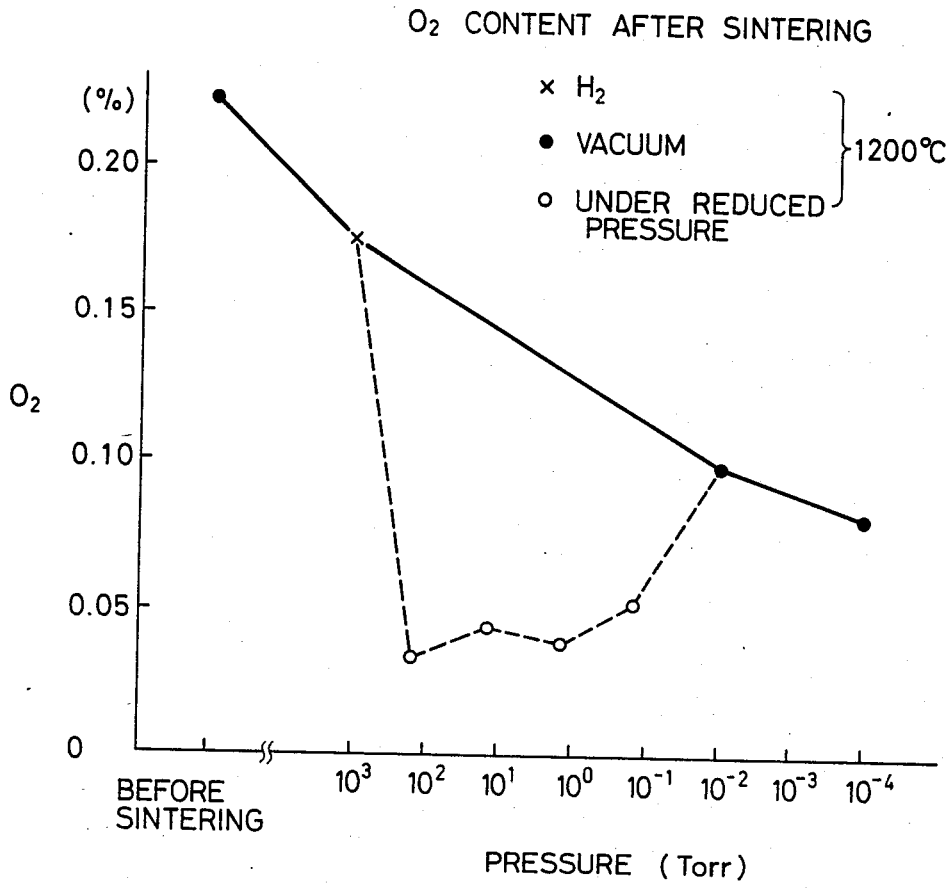
FIG. 3 is a diagram showing the relation between the pressure in the sintering furnace supplied with carbon monoxide gas and the content of oxygen in the sintered product.

When the temperature is higher than 800° C., the reactions (1), (2) and (3) involving carbon monoxide become significant. Therefore, to perform these reactions continuously with efficiency, it is necessary to control the $P_{CO_2}/P_{CO}$ ratio in the furnace and remove the resulting gases by supplying carbon monoxide from outside the furnace. There are two basic methods of doing this. One is to hold the pressure at between 0.2 to 100 Torr throughout the period from the point in time when the temperature is elevated to 800° C. or higher until the cooling step is completed (this method is indicated by A above), and the other method is to hold the pressure of carbon monoxide at between 100 and 500 Torr until the sintering temperature is reached, and then perform the sintering step in vacuum at a pressure of $10^{-2}$ Torr (this method is indicated by B above). The two methods are equally effective, but a material containing an element having high vapor pressure (e.g., Cr, Al, Cu) is preferably treated by the method A because the method B causes a greater loss in the content of these elements due to evaporation. In the process of this invention, the pressure is limited to between 0.2 and 500 Torr because, as shown in FIG. 3, the oxygen level of the sintered product is minimized at a pressure in this range, and at the same time, the product has good characteristics. If the pressure is less than 0.2 Torr, the desired effect is not achieved by supplying carbon monoxide, and if the pressure is greater than 500 Torr, no appreciable advantage is obtained and increased precipitation of carbon makes it difficult to obtain a sintered product having a uniform carbon concentration.

(2) Heat treatment

| Temperature | Atmosphere & pressure |
|---|---|
| sintering temp. → | $N_2$ 0.3–300 Torr |

-continued

| Temperature | Atmosphere & pressure |
|---|---|
| 750° C. → 950° C. | |
| 950° C. → room temp. | $N_2$ 300–1500 Torr or oil quenching |

When the sintering procedure is followed by a heat treatment, the sintered product is cooled from the sintering temperature to an $A_1$ transformation point before it is heated again to a temperature higher than 900° C. for quenching in high-pressure nitrogen or oil. When the sintering procedure is followed by carburization or nitridation, a hydrocarbon gas such as $CH_4$ or $C_3H_8$, nitrogen or decomposed ammonia gas is supplied in the later stage of sintering procedure under the conditions specified above to control the pressure in the furnace at between 0.3 and 300 Torr. In this way, the sintered product is transferred to a heat treating step directly without being exposed to external air. One advantage of this method is that it achieves complete prevention of oxidation during heat treatment, something that has been a great problem with the production of a sintered steel containing Mn, Cr, Si, Al, V, Ti or the like. Another advantage is that carburization and nitridation is possible while the sintered product remains in a highly activated state. In consequence, the method of this invention can achieve a heat treatment under conditions which can be controlled with great accuracy. It will therefore be understood that sintering must be immediately followed by heat treatment to achieve one object of this invention, i.e., production of a sintered steel having good mechanical properties and high wear resistance which contains an element such as Cr, Mn, B, Si, V, Al or Ti that has high affinity for oxygen.

The method of this invention can also be applied to produce a sintered magnetic material or sintered stainless which is required to have corrosion resistance and magnetic properties. In this case, the temperature, pressure and atmosphere conditions for the sintering procedure comprising the steps of temperature elevation, sintering, and cooling are controlled as follows:

| | | |
|---|---|---|
| room temp. → 800–900° C. | vacuum | $10^{-1}$ Torr or less |
| 800–900° C. → sintering temp. | CO | 50–500 Torr |
| sintering temp. | vacuum | $10^{-2}$ Torr or less |
| sintering temp. → room temp. | $H_2$ | 0.2–300 Torr |

The purpose of elevation to vacuum while the temperature is elevated from room temperature to a temperature between 800° and 900° C. is to remove the gas adsorbed on the surface of metal particles, and evacuation must be performed until the pressure is $10^{-1}$ Torr or less. The purpose of supplying carbon monoxide gas at a temperature higher than 800° C. is to increase the partial pressure of carbon monoxide ($P_{CO}$) in the furnace and reduce the oxide through the reaction: $MO+CO \rightarrow M+CO_2$ (wherein M is a metal). By supplying carbon monoxide under reduced pressure, part of the oxides of Mn, Cr, Si, Al, B, and Ti that are hardly reduced at atmospheric pressure can be reduced, and consequently, sintering in vacuum in the subsequent step is promoted significantly. To provide maximum efficiency, it is required that the pressure in the furnace being supplied with carbon monoxide at a temperature higher than 800° C. be controlled to be in the range of from 50° to 500° C. (this causes carbon to be included within iron) and that the subsequent sintering be performed at the maximum degree of vacuum. This is to achieve simultaneous removal of oxygen and carbon that are highly detrimental to magnetic properties and corrosion resistance. The mechanism by which the two elements are removed is represented by the following reaction: $MO+C \rightarrow M+CO$ (wherein M is a metal).

The cooling as the final step of the sintering procedure may be performed in vacuum or nitrogen, but for the purpose of achieving complete decarburization and deoxidation and for providing the metal particles with a polygonal shape that is necessary for producing a magnetic material having improved characteristics, it is preferred that hydrogen gas be supplied and the pressure in the furnace be held at between 0.2 and 300 Torr.

This invention is now described in greater detail by reference to the following examples, which are given here for illustrative purposes only, and are not intended to limit the scope of the invention. Amounts are in parts by weight unless otherwise indicated.

EXAMPLE 1

Two types of Mn—Cr steel powder having the chemical compositions indicated in Table 1 below were mixed with 0.4% of graphite, compressed into a green compact.

TABLE 1

Chemical Composition of Mn—Cr Steel Powder

| Powder Sample | $O_2$ | Mn | Cr | Mo | Si | C |
|---|---|---|---|---|---|---|
| I | 0.08 (%) | 0.89 | 1.02 | 0.25 | 0.04 | 0.11 |
| II | 0.42 | 0.86 | 1.02 | 0.24 | 0.03 | 0.17 |

The green compacts thus obtained were sintered under the conditions indicated in Table 2 below.

TABLE 2

Sintering Conditions

| | | Temperature | Atmosphere & Pressure | |
|---|---|---|---|---|
| This Invention | A | Room temp. → 800° C. | Vacuum | $2 \times 10^{-2}$ Torr |
| | | 800° C. → 1250° C. | CO | 30 Torr |
| | | 1250° C. × 1 hr | CO | 30 Torr |
| | | 1250° C. → Room temp. | $N_2$ | 0.3–1300 Torr |
| | B | Room temp. → 800° C. | Vacuum | $2 \times 10^{-2}$ Torr |
| | | 800° C. → 1250° C. | CO | 300 Torr |
| | | 1250° C. × 1 hr | Vacuum | $2 \times 10^{-2}$ Torr |
| | | 1250° C. → Room temp. | $N_2$ | 0.3–1300 Torr |
| | C | Room temp. → 800° C. | Vacuum | $2 \times 10^{-2}$ Torr |
| | | 800° C. → 1250° C. | CO | 100 Torr |
| | | 1250° C. × 1 hr | Vacuum | $2 \times 10^{-2}$ Torr |
| | | 1250° C. → Room temp. | $N_2$ | 0.3–1300 Torr |
| Conventional | D | Room temp. → 1250° C. | $H_2$ | (continuous furnace of walking beam type) |
| | | 1250° C. × 1 hr | $H_2$ | (continuous furnace of |

TABLE 2-continued

| | Sintering Conditions | | |
|---|---|---|---|
| | Temperature | Atmosphere & Pressure | |
| | | | walking beam type) |
| | 1250° C. → Room temp. | $H_2$ | (continuous furnace of walking beam type) |
| E | Room temp. → 1250° C. | $NH_3$ | cracked (continuous furnace of walking beam type) |
| | 1250° C. × 1 hr | | |
| | 1250° C. → Room temp. | | |
| F | Room temp. → 1250° C. | Vacuum | $2 \times 10^{-2}$ Torr |
| | 1250° C. × 1 hr | Vacuum | $2 \times 10^{-2}$ Torr |
| | 1250° C. → Room temp. | Vacuum | $2 \times 10^{-2}$ Torr |
| G | Room temp. → 800° C. | $H_2$ | 50 Torr |
| | 800° C. → 1250° C. | CO | 30 Torr |
| | 1250° C. × 1 hr | Vacuum | $2 \times 10^{-2}$ Torr |
| | 1250° C. → Room temp. | $N_2$ | 0.3–1300 Torr |

The mechanical properties and oxygen content of the sintered products are shown in Table 3 below.

TABLE 3

| | | Evaluation of Mechanical Properties | | | | |
|---|---|---|---|---|---|---|
| Sintering Method | | Powder | Density After Sintering ($g/cm^3$) | Tensile Strength ($kg/mm^2$) | Impact Strength ($kg\text{-}m/cm^2$) | $O_2$ Level (%) |
| This Invention | A | I | 7.0 | 56 | 2.3 | 0.030 |
| | | II | 6.8 | 50 | 1.9 | — |
| | B | I | 7.0 | 55 | 2.5 | 0.025 |
| | | II | 6.8 | 50 | 2.0 | — |
| | C | I | 7.0 | 54 | 2.3 | 0.030 |
| | | II | 6.8 | 49 | 1.8 | — |
| Conventional Method | D | I | 7.0 | 35 | 1.5 | 0.18 |
| | | II | 6.8 | 30 | 1.0 | — |
| | E | I | 6.95 | 30 | 1.0 | 0.25 |
| | | II | 6.70 | 25 | 0.7 | — |
| | F | I | 7.0 | 46 | 1.7 | 0.12 |
| | | II | 6.8 | 40 | 1.2 | — |
| | G | I | 7.0 | 50 | 1.8 | 0.08 |
| | | II | 6.8 | 43 | 1.3 | — |

As Table 3 above shows, it was difficult to reduce the oxygen content to lower than 0.08% by the conventional sintering method, but with the method of this invention, the oxygen level could be reduced to 0.03% or less. As a result, the sintered products obtained by the method of this invention had strength and toughness that were 60% to 80% higher than those of the products obtained by the conventional method. It was also confirmed that a metal powder having low oxygen content must be used to achieve a high value in toughness.

EXAMPLE 2

The Mn—Cr steel powder I of Example 1 as treated by three different methods. Method (A) involved sintering and immediate heat treatment according to the method of this invention; method (B) involved sintering under conditions according to this invention and heat treatment under conventional conditions; and the method (C) consisted of sintering and heat treatment both of which were conducted under conventional conditions. For the specific conditions of the respective methods, reference is made to Table 4 below.

TABLE 4

| Sintering | Heat Treatment |
|---|---|
| A Room temp. → 800° C. $10^{-1}$ Torr<br>800 → 1250° C. CO 30 Torr<br>1250° C. × 1 hr CO 30 Torr | 1250 → 900° C. $N_2$ 30 Torr<br>900 → Room temp. 1000 Torr<br>Tempering at 400° C. |

TABLE 4-continued

| Sintering | Heat Treatment |
|---|---|
| B Room temp. → 800° C. $10^{-1}$ Torr<br>800 → 1250° C. CO 30 Torr<br>1250° C. × 1 hr CO 30 Torr | 940° C. → Oil quenching |
| C Room temp. → 1250° C. $H_2$<br>1250° C. × 1 hr $H_2$<br>1250° C. → Room temp. $H_2$ | 940° C. → Oil quenching |

The mechanical properties and oxygen content of the resulting products are set forth in Table 5 below.

TABLE 5

| | Hardness ($R_A$) | Tensile Strength ($kg/mm^2$) | Impact Strength ($kg\text{-}m/cm^2$) | $O_2$ Level (%) |
|---|---|---|---|---|
| A | 60–65 | 125 | 1.5 | 0.02 |
| B | 55–65 | 120 | 1.3 | 0.05 |
| C | 45–60 | 90 | 0.5 | 0.29 |

As shown in Table 5 the product obtained by method (A) had the highest strength and toughness. This appears to be due to the fact that the heat treatment was performed immediately after the sintering without contact with external air and the reoxidation during heat treatment could be prevented completely.

EXAMPLE 3

The powder I of Example 1 was sintered by the methods B, D and G, and the sintered products were hot-forged to a density of 100%. The mechanical properties of the respective products are set forth in Table 6 below.

TABLE 6

| | Hardness ($R_C$) | Tensile Strength ($kg/mm^2$) | Impact Strength ($kg\text{-}m/cm^2$) |
|---|---|---|---|
| B | 53 | 150 | 4.8 |
| C | 35 | 140 | 2.0 |
| G | 34 | 145 | 3.2 |

The product obtained by the method B according to this invention had very good toughness as compared with the products obtained by the conventional method.

EXAMPLE 4

Two types of powder, (1) Fe—5Cr—5Mo—6W—2-V—0.9C (high-speed steel) and (2) Fe—17Cr—0.-5Al—2.5C, were compressed into a green compact, and sintered under the conditions indicated in Table 7 below.

TABLE 7

| Sintering Conditions | |
|---|---|
| Temperature | Atmosphere & Pressure |
| This Invention | |
| Room temp.-800° C. | Vacuum, $10^{-2}$ Torr |
| 800° C.-1250° C. (1180° C.) | CO, 100 Torr |
| 1250° C. (1180° C.) × 1 hr | Vacuum/$N_2$, $10^{-2}$-100 Torr |
| 1250° C. (1180° C.)-Room temp. | $N_2$, 500-1300 Torr |
| Conventional Method | |
| Room temp.-1250° C. (1180° C.) | $H_2$, (continuous furnace of pusher type) |
| 1250° C. (1180° C.) × 1 hr | $H_2$, (continuous furnace of pusher type) |
| 1250° C. (1180° C.)-room temp. | $H_2$, (continuous furnace of pusher type) |

N.B. (The figure in parentheses indicates the temperature for sintering the powder 2).

The mechanical properties and wear resistance of the sintered products are shown in Table 8 below.

TABLE 8

| Mechanical Properties and Wear Resistance of the Sintered Products | | | | |
|---|---|---|---|---|
| | | Density (g/cm$^3$) | Hardness ($R_C$) | Resistance to Pitting |
| This Invention | (1) | 8.0 ± 0.1 | 55 ± 3 | A good |
| | (2) | 7.5 ± 0.1 | 47 ± 3 | A good |
| Conventional Method | (1) | 8.0 ± 0.2 | 45 ± 6 | C inferior |
| | (2) | 7.5 ± 0.2 | 40 ± 6 | X poor |

From the result shown in Table 8, it can be seen that the variation in carbon level of the products obtained by the method of this invention was half that of the products obtained by the conventional method. This resulted in increased stability of the surface hardness. In addition, nitrogen that entered into the powder during sintering helped provide significantly improved resistance to pitting.

EXAMPLE 5

The following three compositions having a hard phase of Mn—30Cr, Ni—50Mn and Mn—20Si of a thickness of 20 to 80μ, respectively, were sintered under the conditions indicated in Table 9.

(1) Fe—7Mn—3Cr—1C
(2) Fe—5Mn—5Ni—1C
(3) Fe—8Mn—1.6Si—1C

TABLE 9

| Sintering Conditions | |
|---|---|
| Temperature | Atmosphere & Pressure |
| This Invention | |
| Room temp.-800° C. | Vacuum 2 × $10^{-2}$ Torr |
| 800° C.-1200° C. | CO 30 Torr |
| 1200° C. × 1 hr | Vacuum 2 × $10^{-2}$ Torr |
| 1200° C.-Room temp. | $N_2$ 30 – 1300 Torr |
| Conventional Method | |
| Room temp.-1200° C. | $H_2$ (continuous furnace of pusher type) |
| 1200° C. × 1 hr | $H_2$ (continuous furnace of pusher type) |
| 1200° C. × Room temp. | $H_2$ (continuous furnace of pusher type) |

The mechanical properties and wear resistance of the resulting sintered products are shown in Table 10 below.

TABLE 10

| Mechanical Properties and Wear Resistance of the Sintered Products | | | | | |
|---|---|---|---|---|---|
| | Material | Density (g/cm$^3$) | Hardness ($R_B$) | Tensile Strength (kg/mm$^2$) | Wear (mm$^2$/kg) |
| This Invention | (1) | 6.8 | 90 | 45 | $6 \times 10^{-7}$ |
| | (2) | 6.9 | 87 | 48 | $5 \times 10^{-7}$ |
| | (3) | 6.8 | 78 | 43 | $8 \times 10^{-7}$ |
| Conventional Method | (1) | 6.8 | 91 | 40 | $35 \times 10^{-7}$ |
| | (2) | 6.8 | 85 | 41 | $20 \times 10^{-7}$ |
| | (3) | 6.7 | 75 | 39 | $20 \times 10^{-7}$ |

Test conditions:
Pressure = 6.6 kg/cm$^2$, Velocity = 3.9 m/min., Length = 200 m, rubbed against martensitic heat resistant steel according to JIS SUH-3 consisting of 0.4% of C, 2% of Si, 11% of Cr, 1% of Mo and the balance Fe.

From the results shown in Table 10, it can be seen that the products obtained by the method of this invention had improved strength and wear resistance over the products obtained by sintering in a hydrogen atmosphere according to the conventional method. The variation in hardness, dimensions, and carbon level of the former products was half that of the later products.

EXAMPLE 6

Ferrous magnetic materials containing Si and Al are known to have high electrical resistance, magnetic permeability, and saturation flux density, but due to oxidation of Si and Al it is very difficult to produce these materials on a commercial scale. We conducted the following experiment to demonstrate the effectiveness of this invention to produce ferrous magnetic materials containing Al or Si: Atomized iron powder (under 100 mesh) was mixed with Fe—Si or Fe—Al powder (under 325 mesh) and conditioned to have the formulations (1), (2) and (3) indicated below: (1) Fe—6.5Si, (2) Fe—10Al, (3) Fe—10Si—6Al. The formulations were compressed into a green compact to give a density of 80% and sintered under the conditions indicated in Table 11 below.

TABLE 11

| Sintering Conditions | |
|---|---|
| Temperature | Atmosphere & Pressure |
| This Invention | |
| Room temp. → 800° C. | Vacuum $10^{-2}$ Torr |
| 800° C. → 1350° C. | CO 100 Torr |
| 1350° C. × 1 hr | Vacuum $10^{-4}$ Torr |
| 1350° C. → Room temp. | $H_2$ 30 Torr |
| Conventional Method | |
| Room temp. → 1350° C. | $H_2$ (continuous furnace of walking beam type) |
| 1350° C. × 1 hr | $H_2$ (continuous furnace of walking beam type |
| 1350° C. → Room temp. | $H_2$ (continuous furnace of walking beam type) |

The magnetic properties of the sintered products are set forth in Table 12 below.

TABLE 12

| Evaluation of Magnetic Properties | | | | | |
|---|---|---|---|---|---|
| | Material | Density (g/cm$^2$) | H (O) | μ max | $B_{25}$ (Gauss) |
| This Invention | (1) | 7.4 | 0.3 | 9,000 | 14,200 |
| | (2) | 6.7 | 0.5 | 8,500 | — |
| | (3) | 6.8 | 0.1 | 96,000 | 10,500 |
| Conventional Method | (1) | 7.1 | 0.7 | 7,500 | 14,000 |
| | (2) | 6.5 | 1.0 | 5,000 | — |
| | (3) | 6.6 | 0.7 | 62,000 | 10,000 |

The products sintered by the method of this invention were more polygonal in shape than those sintered by the conventional method in a hydrogen atmosphere, and they had greatly improved coercive force and saturated flux density as will be evident from the results shown in Table 12 above. This appears to be due to the fact that oxygen and carbon that were the elements that had an adverse effect on the magnetic properties were removed effectively during sintering.

EXAMPLE 7

A 304 stainless steel powder (under 100 mesh) was compressed at a pressure of 7 t/cm$^2$ and sintered under the conditions indicated in Table 13 below.

TABLE 13

| Sintering Conditions | |
|---|---|
| Temperature | Atmosphere & Pressure |
| This Invention | |
| Room temp.-800° C. | Vacuum 2 × $10^{-2}$ Torr |
| 800° C.-1250° C. | CO 100 Torr |
| 1250° C. × 1 hr | Vacuum 2 × $10^{-2}$ Torr |
| 1250° C.-Room temp. | $H_2$ 30 Torr |
| Conventional Method | |
| Room temp.-1250° C. | $H_2$ (continuous furnace of pusher type) |
| 1250° C. × 1 hr | $H_2$ (continuous furnace of pusher type) |
| 1250° C.-room temp. | $H_2$ (continuous furnace of pusher type) |

The mechanical properties and corrosion resistance of the sintered products are shown in Table 14.

TABLE 14

| Mechanical Properties and Corrosion Resistance | | |
|---|---|---|
| | This Invention | Conventional Method |
| Density after Sintering | 7.1 g/cm$^2$ | 7.0 g/cm$^2$ |
| Tensile Strength | 35 kg/mm$^2$ | 35 kg/mm$^2$ |
| Impact Strength | 8.0 kg-m/cm$^2$ | 5.1 kg-m/cm$^2$ |
| (Immersed for 10 hr in 10% $H_2SO_4$ at 80° C.) | 380 mg/cm$^2$ | 1100 mg/cm$^2$ |

From the results shown in Table 14 above, it can be seen that the method of this invention was found very effective for producing improved impact strength and corrosion resistance. This appears to be due to the fact that carbon and oxygen were removed effectively.

While the invention has been described in detail and with reference to specific embodiments thereof, it will be apparent to one skilled in the art that various changes and modifications can be made therein without departing from the spirit and scope thereof.

What is claimed is:

1. A method for producing a sintered ferrous alloy containing at least one alloying element whose standard free energy for oxide formation at 1000° C. is 11,000 cal/g mol $O_2$ or less and also containing oxygen and carbon which comprises the steps of:

(1) elevating the temperature of a green compact comprising said at least one alloying element, oxygen and carbon, first from room temperature to 800°-900° C. and then from 800°-900° C. to sintering temperature;

(2) sintering in a sintering furnace at said sintering temperature; and (3) cooling by decreasing the temperature from sintering temperature to room temperature;

wherein the pressure in the sintering furnace is $10^{-1}$ Torr or less while elevating the temperature from room temperature to 800°-900° C., the pressure in the sintering furnace is maintained at a substantially constant pressure between about 0.2 and 500 Torr by supplying a reducing gas from the time of reaching 800°-900° C. to at least the time of reaching the sintering temperature, the pressure in the sintering furnace is maintained at a substantially constant value during the sintering step, and all pressure changes except for the pressure change that occurs at the time of reaching 800°-900° C. during step (1) only occur, if at all, when one process step leads to another process step.

2. A method according to claim 1, wherein the alloying element is one element selected from the group consisting of Mn, Cr, V, B, Si, Al, and Ti.

3. A method according to claim 1, wherein quenching is performed during the cooling step following the sintering step by increasing the pressure of the reducing gas to at least 500 Torr or by performing oil cooling.

4. A method according to claims 1, 2, or 3, wherein nitrogen gas, decomposed ammonia gas or a hydrocarbon gas is supplied in a late stage of the sintering step to perform nitridation and carburization subsequent to the sintering.

5. A method according to claim 4, wherein said alloy is a sintered Mn—Cr steel which contains residual oxygen in an amount of not higher than 0.03% by weight.

6. A method according to claims 1, 2, or 3, wherein the reducing gas is carbon monoxide gas.

7. A method according to claim 6, wherein said alloy is a sintered Mn—Cr steel which contains residual oxygen in an amount of not higher than 0.03% by weight.

8. A method according to claims 1, 2, or 3, wherein the temperature is elevated to a temperature between 800° and 900° C. at a pressure of $10^{-1}$ Torr or less in the temperature elevation step, then the temperature is elevated from the temperature between 800° and 900° C. to a sintering temperature in the presence of carbon monoxide gas at a pressure between about 100 and 500 Torr, and then the sintering step is performed at said sintering temperature at a pressure of $10^{-2}$ Torr or less.

9. A method according to claim 8, wherein said alloy is a sintered Mn—Cr steel which contains residual oxygen in an amount of not higher than 0.03% by weight.

10. A method according to claims 1, 2, or 3, wherein the temperature is elevated to a temperature between 800° and 900° C. at a pressure of $10^{-1}$ Torr or less in the temperature elevation step, then the temperature is elevated from the temperature between 800° and 900° C. to a sintering temperature in the presence of carbon monoxide gas at a pressure between 0.2 and 100 Torr, and then the sintering is performed at said sintering temperature in the presence of carbon monoxide gas at a pressure between 0.2 and 100 Torr.

11. A method according to claim 10, wherein said alloy is a sintered Mn—Cr steel which contains residual oxygen in an amount of not higher than 0.03 by weight.

12. A method according to claim 10, wherein said alloy is a sintered Mn—Cr steel which contains residual oxygen in an amount of not higher than 0.03% by weight.

13. A method according to claims 1, 2, or 3, wherein said alloy contains carbon in an amount from 0.1 to 2.5% by weight, at least one element selected from Mn in an amount from 0.5 to 2.5% by weight, and Cr in an amount from 0.3 to 1.5% by weight, and the balance is substantially iron.

14. A method according to claim 13, wherein said alloy is a sintered Mn—Cr steel which contains residual oxygen in an amount of not higher than 0.03% by weight.

15. A method according to claims 1, 2, or 3, wherein said alloy is high-speed steel which contains C in an amount from 0.5 to 2.0 by weight, at least one element selected from Cr in an amount from 3.5 to 5.5% by weight, and V in an amount from 4.0 to 6.0%, and the balance is substantially iron.

16. A method according to claim 1, wherein the alloying element is at least one of Cr, Mn, Si, B, Al and Ti.

17. A method according to claim 1 or 9, wherein the temperature is elevated to a temperature between 800° and 900° C. at a pressure of $10^{-1}$ Torr or less in the temperature elevation step, then the temperature is elevated from the temperature between 800° and 900° C. to a sintering temperature in the presence of carbon monoxide gas at a pressure between about 50 to 500 Torr, then the sintering step is performed at said sintering temperature at a pressure of $10^{-2}$ Torr or less, and then during the cooling step the temperature is reduced to room temperature in the presence of hydrogen gas at a pressure between about 0.2 and 300 Torr.

18. A method according to claim 1 or 9, wherein said alloy is a sintered high-permeability iron-based soft magnetic material, which contains at least one element selected from Si in an amount from 0.5 to 12% by weight, Al in an amount from 0.5 to 17% by weight, and B in an amount from 0.1 to 2% by weight, and the balance is substantially iron.

19. A method according to claim 1 or 9, wherein said alloy is sintered stainless steel, which contains at least one element selected from Cr in an amount from 10 to 30% by weight, and Mn in an amount from 5 to 20% by weight and the balance is substantially iron.

* * * * *